US005920286A

United States Patent [19]

Mohebbi

[11] Patent Number: 5,920,286

[45] Date of Patent: Jul. 6, 1999

[54] STABILISATION OF PHASED ARRAY ANTENNAS

[75] Inventor: Behzad Mohebbi, Swindon, United Kingdom

[73] Assignee: Motorola, Inc., Schaumburg, Ill.

[21] Appl. No.: 08/947,276

[22] Filed: Oct. 8, 1997

[30] Foreign Application Priority Data

Oct. 12, 1996 [GB] United Kingdom ..... 96213608

[51] Int. Cl.[6] ..... G01S 3/16

[52] U.S. Cl. ..... 342/383; 342/378; 342/380; 342/382

[58] Field of Search ..... 342/361, 362, 342/368, 378, 380, 382, 383

[56] References Cited

U.S. PATENT DOCUMENTS 5,027,124 6/1991 Fitzsimmons et al. .

FOREIGN PATENT DOCUMENTS 0110260 6/1984 European Pat. Off. .
2236431 4/1991 United Kingdom .

*Primary Examiner*—Thomas Tarcza
*Assistant Examiner*—Dao L. Phan
*Attorney, Agent, or Firm*—Kenneth A. Haas

[57] ABSTRACT

A method of stabilizing the action of a phased array antenna system in which the amplitudes and phases of signals applied to, or produced by, elements of the antenna are monitored, differences are detected and suitable weighting factors are determined and applied to remove the differences between the amplitudes and phases of the said signals.

Transmitting and receiving antenna systems are described.

11 Claims, 4 Drawing Sheets

STABILISATION OF PHASED ARRAY ANTENNAS

The present invention relates to phased array, or adaptive antenna systems, and more specifically to such antenna systems for use in connection with cellular radio communication systems.

Phased array, or adaptive, antenna systems have a plurality of elements which in a transmitting mode are fed with output signals which have a predetermined amplitude and phase relationship. The signals radiated by each element of the antenna interact to form a beam of radiation which may have a fixed orientation or be scanned, depending on the phase relationship between the output signals applied to the elements of the antenna. For such an antenna to function satisfactorily it is necessary for the amplitudes and relative phases of the signals in each branch of the antenna system to be as stable as possible.

Hitherto this has been done by methods such as physically adjusting the components of the antenna after it has been constructed, or by means of a closed loop analogue feedback control system which adjusts the gain and phase mismatch between the elements of the antenna, using additional radio frequency active elements.

It is an object of the present invention to provide an improved method and apparatus for stabilising the action of a phased array antenna system. Although the invention is concerned primarily with transmitting antennas, it can be applied to phased array antennas used in a receiving mode.

According to the invention, there is provided a method of stabilising the action of a phased array antenna system, comprising the operations of monitoring the amplitudes and phases of signals applied to or produced by elements of the antenna, detecting departures from a norm of the amplitudes and phases of the said signals, deriving correction signals related thereto and using the correction signals to vary the action of a signal handling network associated with the elements of the antenna to restore to the norm the amplitudes and phases of the signals applied to or produced by the elements of the antenna.

The operations of monitoring the amplitudes and phases of the signals applied to or produced by the elements of the antenna, detecting departures from a norm of the said signals, and generating correction signals related thereto may comprise the operations of extracting identical proportions of the said signals, comparing the extracted signals with a reference signal, and deriving an error function signal related to departures of the amplitudes and phases of the extracted signals from values derived from the reference signal.

The comparison of the extracted signals with the reference signal may be done by delaying by a known amount each of the extracted signals with respect to its predecessor, adding the delayed extracted signals to produce a composite complex signal and convolving that signal with a time reversed complex conjugate of a reference signal.

Another way in which the comparison of the extracted signals with the reference signal may be done is to compare sequentially each extracted signal with the time reversed complex conjugate of the reference signal.

When the antenna is used in a transmitting mode, the said signals may comprise the output signals applied to the elements of the antenna and the reference signal may be derived from a portion of the signal to be transmitted by the antenna.

According to the invention in a second aspect, there is provided an apparatus for stabilising the action of a phased array transmitting antenna, comprising means for applying to radiating elements of the antenna output signals having a predetermined amplitude and phase relationship means for extracting identical proportions of the said output signals, means for comparing the extracted signals with a reference signal, means for producing an error function signal related to differences between the extracted signals and the reference signal and means responsive to the error function signal to vary the action of the means for applying the output signals to the radiating elements of the antenna to maintain the predetermined amplitude and phase relationships of the said output signals.

According to the invention in a third aspect, there is provided an apparatus for stabilising the action of a phased array receiving antenna, comprising a plurality of receivers, each receiver being connected to an element of the antenna, means for extracting a specified proportion of input signals produced by the elements of the antenna and applied to the receivers, means for comparing the extracted signals with a reference signal, means for producing an error function signal related to differences between the extracted signals and the reference signal and means responsive to the error function signal to operate upon the output signals from the receivers to equalise the amplitudes and phases of the output signals from the receivers.

The means for comparing the extracted signals with the reference signal may comprise a series of delay devices so arranged that each extracted signal is delayed by the same amount relative to its predecessor, means for adding the successively delayed extracted signals and producing a complex composite signal, a comparator including means for convolving the composite signal with a time reversed complex conjugate of the reference signal and means for deriving an error function signal related to differences between the composite signal and the reference signal.

Alternatively, the means for comparing the extracted signals with the reference signal may comprise means for connecting the extracted signals successively to the comparator.

When the antenna is used in a transmitting mode, the means for applying the output signals to the radiating elements of the antenna may comprise an output signal distribution network including a plurality of weighting circuits each connected to an associated radiating element of the antenna and there is included means responsive to the error function signal to vary the actions of the weighting circuits to maintain the predetermined amplitude and phase relationship of the output signals applied to the radiating elements of the antenna.

When the antenna is used in the receiving mode, either the received signal from one antenna element can be used to provide a reference signal, or if the form of the received signal is known, as for example if the signal is a radio communication signal which includes a reference portion, then that part of the signal can be generated locally to provide the reference signal.

The invention will now be described, by way of example, with reference to the accompanying drawings, in which, FIG. 1 is a block circuit diagram of a phased array transmission antenna system embodying the invention.

Figure 1:
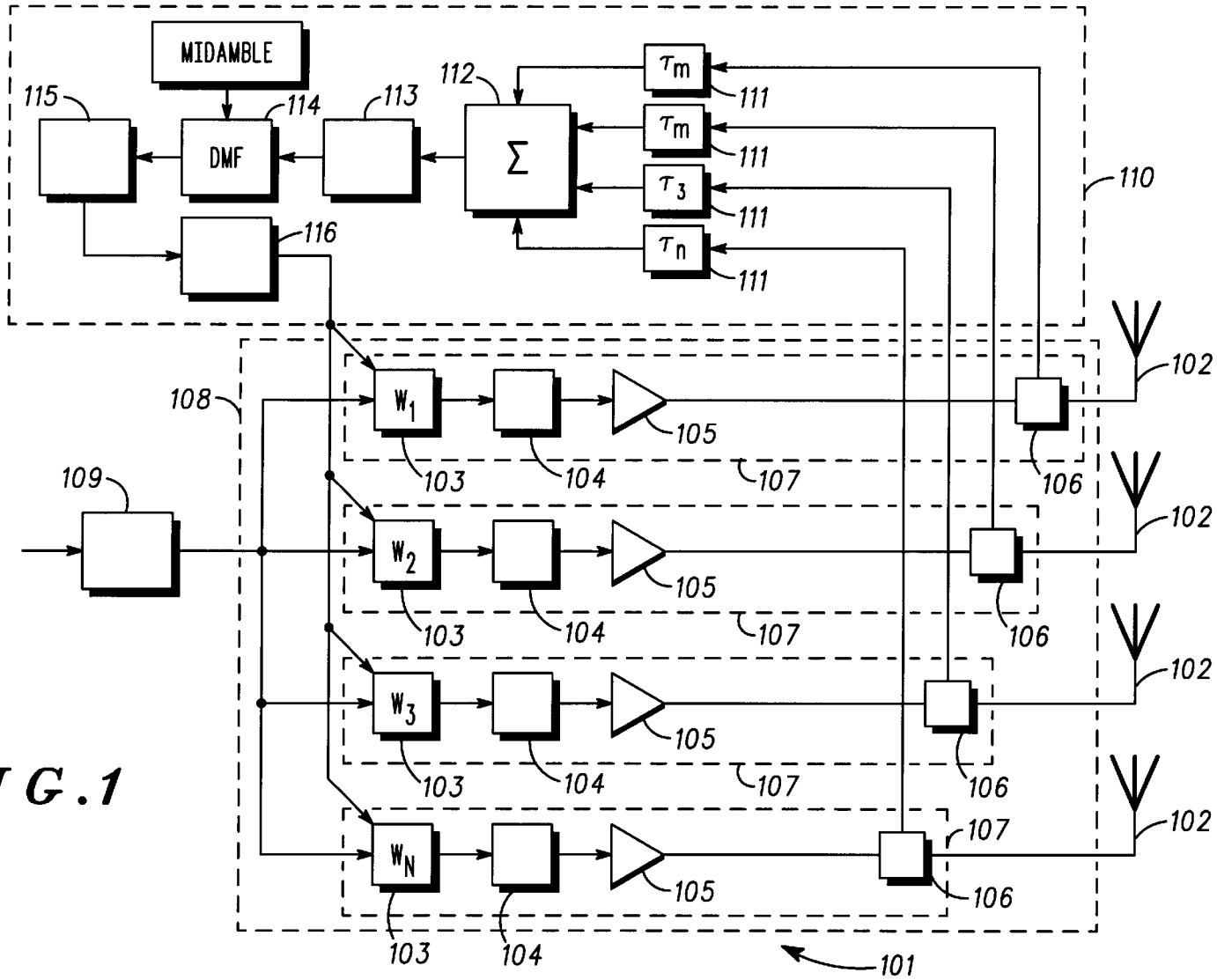

Referring to FIG. 1, a phased array transmission antenna system 101 consists of a plurality of radiating elements 102 to each of which is connected a beam forming weighting circuit 103, a frequency converter 104, a power amplifier 105 and a signal divider 106. Each group of the above forms a branch 107 of an output signal distributing network 108, to which an output signal is applied from a modulator 109.

Connected to the output signal distributing network 108 is a stabilisation network 110 consisting of a plurality of delay devices 111 arranged so that each delay device 111 is connected to a respective signal divider 106. The delay devices 111 are connected to a combiner 112, a frequency converter 113, a comparator in the form of a digital matched filter 114, a complex error calculator 115 and a correction coefficient calculator 116. A reference signal source 117 is connected to the digital matched filter 114. The correction coefficient calculator 116 is connected to each of the weighting circuits 103.

A duplexer 118 connected between each signal divider 106 and its associated radiating element 102 enables that element to be used in a receiving mode, to be described later.

The arrangement shown in FIG. 1 is specifically designed for use with a digital cellular radio communication system and the reference signal supplied by the reference signal source 117 to the digital matched filter 114 is derived from that section of each burst of signals utilised in such systems known as the midamble.

The operation of the system is as follows: A common output signal is generated by the modulator circuit 109 and applied to each weighting circuit 103. Each weighting circuit 103 can operate independently of the others and acts to establish the required amplitude and phase for the signal to be transmitted by its associated antenna element 102. The signal dividers 106 extract an identical fraction of the signals applied to the antenna elements 102 by the output power amplifiers 105. The extracted signals are applied to respective delay devices 111. The delay devices 111 are so arranged that the nth extracted signal is delayed by n times the reciprocal of the repetition rate of the midamble from the signal bursts. The delayed extracted signals are applied to the combiner which produces a composite signal which has a wave form which has similar properties to those in a time dispersive communications channel. The frequency of the extracted signals is reduced to a convenient value by the frequency converter 113 and digitised. After the composite signal has been frequency converted and digitised it is down converted again to produce a complex signal represented by the equation $$\tilde{y(t)} = \sum_{n=1}^{n=N} a_n r(t - nT_m)\exp(j\tilde{\emptyset}(t - nT_m) + \phi_n) \tag{1}$$

where N is the total number of branches 107 in the signal distributing network 101

$a_n$ is the amplitude of the nth beam forming weight $\emptyset_n$ is the phase of the nth beam forming weight r(t) is the envelope of the modulation signal Ø(t) is the phase of the modulation signal $T_m$ is the reciprocal of the midamble repetition rate The digitally matched filter 114 essentially is a complex finite impulse response filter having M taps where M is equal to the number of complex correlation bits in the modulation domain and the weighting of each tap is determined from the time reversed complex conjugate of the transmitted modulation domain midamble. The output signal from the digitally matched filter 114 is given by the equation:

$$\tilde{z(t)} = \sum_{n=1}^{n=M} a_n r(t - nT_m)\exp\{j\tilde{\emptyset}(t - nT_m) + \phi_n\} \otimes r(-t)\exp\{-j\tilde{\emptyset}(-t)\} \tag{2}$$

where $z(\tilde{t})$ is a second time related complex signal, ⊗ denotes convolution and the other symbols have the same meaning as in equation (1)

The output signal function from the digitally matched filter 114 has N correlation peaks, one for each branch 107 of the signal distribution network 108, separated by an interval of nTm.

If the function $z(\tilde{t})$ applied to the complex error calculator 115 is normalised to M, its output is given by an error function $$\in(\tilde{n}T_m) = M^{-1}z'(\tilde{n}T_m) - a_n\exp(j\emptyset_n) \tag{3}$$

where $z'(\tilde{n}T_m)$ is the modified correlation peak containing the complex error produced in the $n^{th}$ branch 107 of the signal distribution network 108.

The error function $\in(\tilde{n}T_m)$ is applied to the coefficient calculator 116 which produces values of weighting function such as to produce appropriate values of $a_n$ and $\emptyset_n$ to maintain balance between the branches 107 of the signal distribution network 108.

The separation of each delay element has to be at least the duration of the midamble period, so as to resolve the amplitude and phase of the signals relating to all N branches 107 of the signal distribution network 108 at the output from the digitally matched filter 114. If this were not so, interference between the respective correlation functions would occur.

Figure 2:
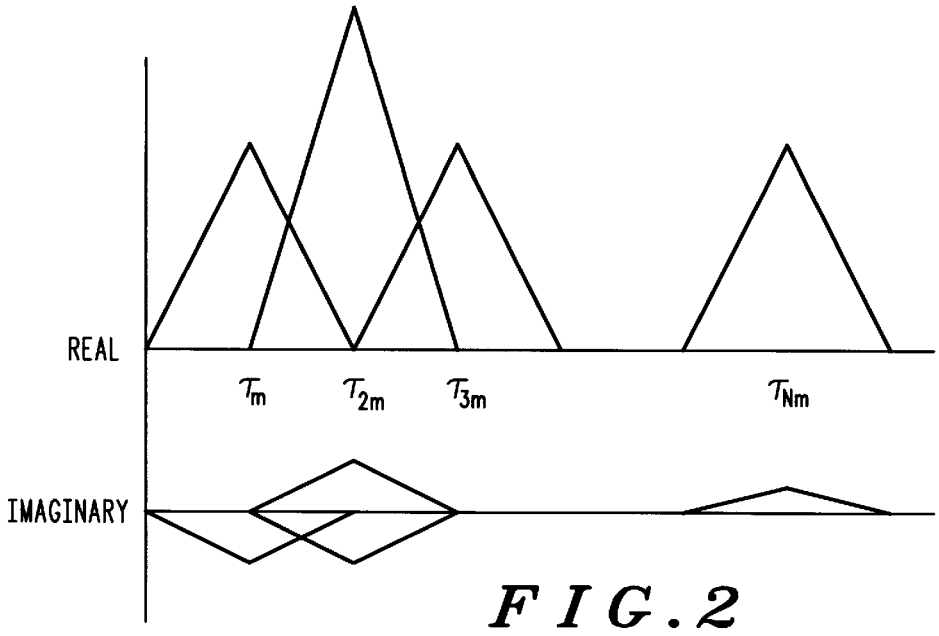
FIG. 2 shows diagrammatically an idealised comparison signal.

FIG. 2 shows the form of the complex output signal from the digital matched filter 114 for the case when the branches 107 of the signal distribution network 108 are perfectly matched. The different magnitudes of the correlation peaks reflect the fact that there are inherent differences in the components which make up the elements 103, 104, 105 and 106 of the branches 107 of the signal distribution network 108.

Figure 3:
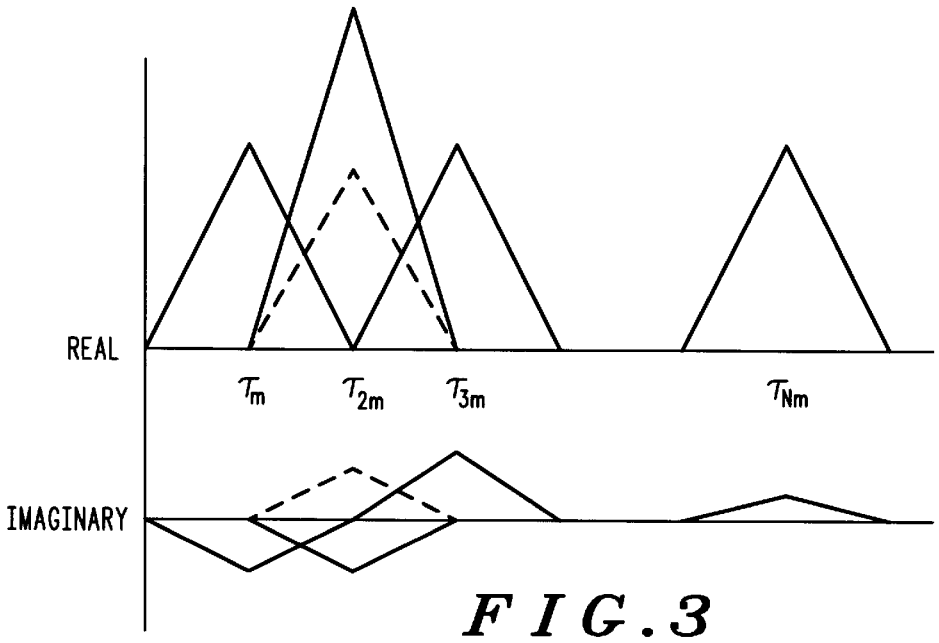
FIG. 3 shows diagrammatically an idealised comparison signal for the antenna system of FIG. 1 in an unbalanced state.

When an amplitude and phase error occurs in the nth branch 107 of the signal distribution network relative to the initial condition shown in FIG. 2, its associated correlation function will be modified accordingly. FIG. 3 shows, by way of example, the situation when an error has occurred in branch 2 of the signal distribution network 108. The changes are shown by the dotted lines.

Figure 4:
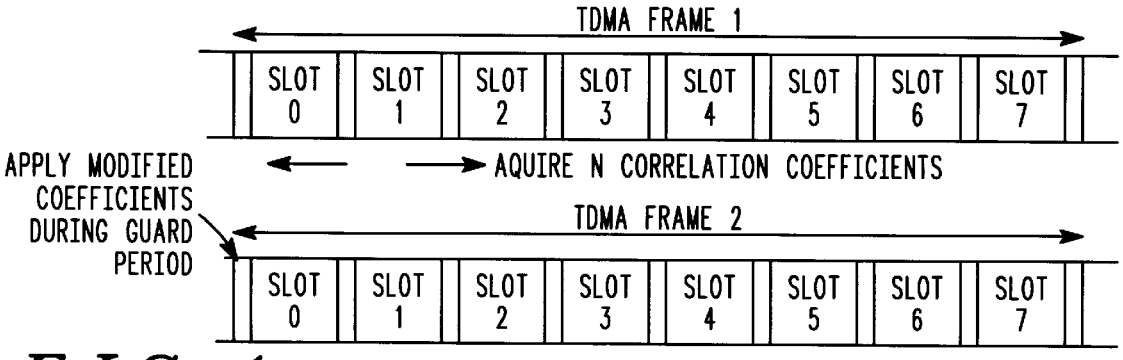
FIG. 4 shows the application of the invention to a time distributed multiple access cellular radio communication system.

If the cellular radio communication system to which the invention is being applied is a time distributed multiple access system such as that known by the acronym GSM each time slot will have its associated beam forming weighting coefficients, and modified weighting coefficients calculated in one time frame will have to be stored until the appropriate time slot occurs in the next time frame. This is illustrated in FIG. 4, which shows the acquisition of N correlation coefficients for time slot 0 in Frame 1, and the application of the modified beam forming coefficients during the guard period prior to time slot 0 in Frame 2.

Figure 5:
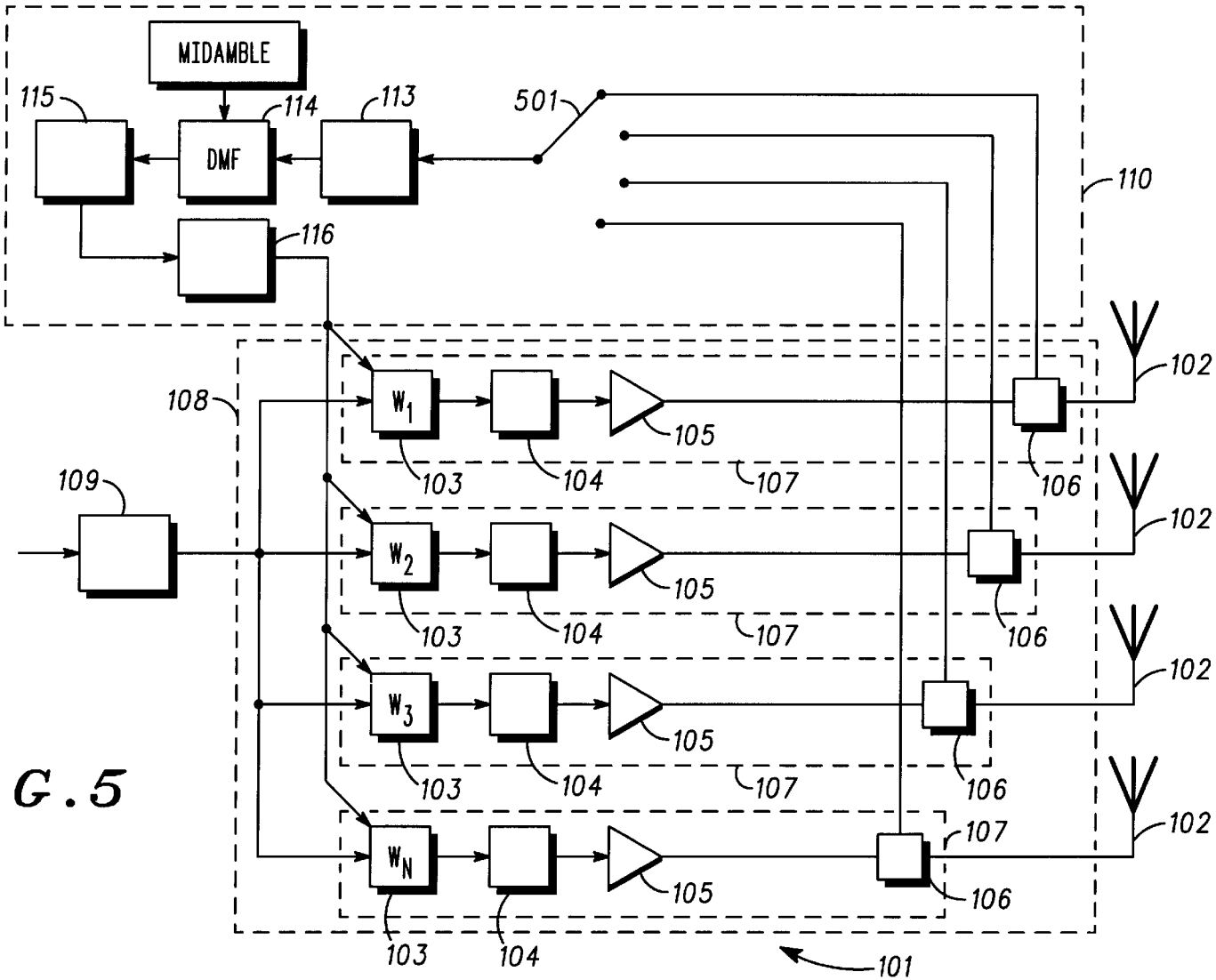
FIG. 5 is a block circuit diagram of a second phased array transmission system embodying the invention.

FIG. 5 shows a block circuit diagram of a second embodiment of the invention. In FIG. 2, those components and the embodiment which are unchanged from the first embodiment have the same reference numerals. Referring to FIG. 5, the delay devices 111 and combiner 112 are replaced by a multiple switch 501 which connects each extracted signal sequentially to the frequency converter 113. The remainder of the system acts as before.

Figure 6:
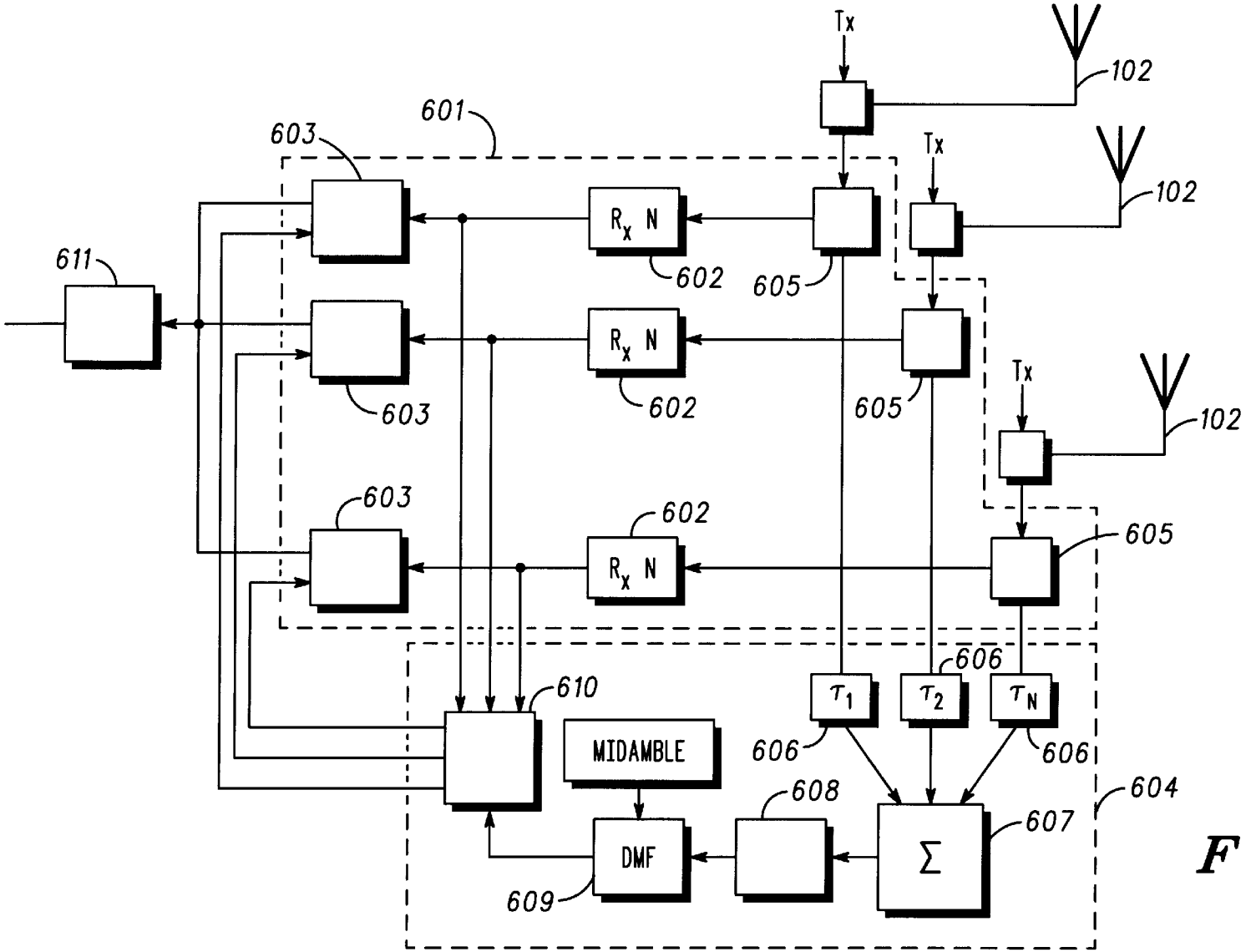
FIG. 6 is a block circuit diagram of a phased array receiving antenna system embodying the invention.

FIG. 6 shows a block circuit diagram showing the invention applied to a phased array antenna system used in a receiving mode. Again, those components which are common to both transmitting and receiving systems have the same reference numerals. Referring to FIG. 6, there is shown the receiving side of a transceiver embodying the invention. A network 601 of N radio receivers 602, corresponds to the branches 107 of the signal distribution network 108 of the transmitting side of the antenna system. Each of the receiver 602 is connected to a beam weighting circuit 603, as before. A stabilisation network 604, mirroring the stabilisation network 110 of the transmitter, is connected to the antenna elements 102 via signal dividing circuits 605. As before, the stabilisation network 604 comprises N delay devices 606 connected to a combiner 607, a frequency converter 608, a digital matched filter 609 to which the midamble of the received signal is applied and a complex error calculator 610, which in this case incorporates a correction co-efficient calculator equivalent to the correction co-efficient calculator 116.

The operation of the stabilisation network 604 is analogous to that of the transmission side of the antenna. A proportion of each of the received signals is extracted by the signal dividers 605 and applied to a respective delay device 606 and thence to the combiner 607. As before, the composite signal is frequency converted, digitised and applied to the digital matched filter 609 to which a reference signal (in the case of a GSM digital radio communication system, the midamble from a signal burst), also is applied. As in the transmission case, the digital matched filter 609 produces a complex output signal which has correlation peaks corresponding respectively to the amplitudes and phases of the signals from each of the antenna elements 102. The complex output signal from the matched digital filter 609 is applied as a reference signal to the complex error function calculator 610. Also applied to the complex error function calculator 610 is a proportion of the respective output signals from the receivers 602 in the network 601. The amplitudes and phases of these signals are compared with the corresponding peaks in the output signal from the digital matched filter 609, correction co-efficient signals are produced and applied to the weighting circuits 603. The final output signals are combined and applied to a demodulator circuit 611. Duplex switches 612 connect the antenna elements to the transmitting or receiving network, as appropriate.

As before, the delay devices 606 and combiner 607 can be replaced by a sequential switch which connects each circuit divider 605, and hence its extracted signal, to the frequency converter 608 directly.

I claim:

1. A method of stabilizing the action of a phased array antenna system, comprising the operations of:

monitoring the amplitudes and phases of signals applied to or produced by elements of the antenna by extracting identical proportions of said signals from extracted signals;

detecting departures from a norm of the amplitudes and phases of the said signals comprising the steps of:

comparing the extracted signals with a reference signal by delaying each extracted signal by a predetermined amount with respect to its predecessor, adding the delayed extracted signals to produce a complex composite signal and convolving that signal with a time reversed complex conjugate of the reference signal, and deriving an error function signal related to departures of the values of the amplitude and phase of the extracted signals from values of the same parameters relating to the reference signal;

deriving clearing correction signals related thereto; and using the clearing correction signals to vary the action of a signal handling network associated with the elements of the antenna to correct for the departures from the norm of the amplitudes and phases of the said signals.

2. A method according to claim 1 wherein the operation of comparing the extracted signals with the reference signal comprises the steps of comparing sequentially each extracted signal with the time reversed complex conjugate of the said reference signal.

3. A method according to claim 1 wherein the antenna forms part of a transmitter and the reference signal is derived from the output signal to be transmitted by the antenna.

4. A method according to claim 3 wherein there is included the operation of deriving correction coefficients from the error function and applying the correction coefficients respectively to weighting circuits adapted to control the amplitude and phase of the output signals applied to an associated radiating element of the antenna.

5. A method according to claim 3 wherein the antenna forms part of a time divided multiple access cellular radio communication system and the reference signal is the midamble of signal bursts generated by a transmitter associated with the antenna, wherein the output signal is in the form of time frames, in which periods of signal transmission are separated by guard periods and correction coefficients related to given signal transmission periods are calculated during one time frame, stored and applied to the weighting circuits during the guard period preceding the same transmission period in the reset time frame.

6. An apparatus for stabilizing the action of a phased array receiving antenna, comprising:

a plurality of receivers, each receiver being connected to an element of the antenna;

means for extracting a specified proportion of input signals produced by the elements of the antenna and applied to the receivers;

means for comparing the extracted signals with a reference signal and producing an error function signal related to differences between the extracted signals and the reference signal comprising:

a series of delay devices so arranged that each extracted signal is delayed by the same amount relative to its predecessor, means for adding the successively delayed extracted signals and producing a complex composite signal related thereto, and a comparator to which the reference signal is applied;

means responsive to the error function signal to operate upon the output signals from the receivers to equalizing the amplitudes and phases of the output signals from the receivers; and means for combining the equalizing signals from the receivers.

7. An apparatus according to claim 6 wherein the means for comparing the extracted signals with the reference signals comprises a switch adapted to connect successively the extracted signals to a comparator to which the reference signal is applied.

8. An apparatus according to any of claim 6 wherein the reference signal is a time reversed complex conjugate of at least a portion of the signal to be received by the antenna and the comparator is adapted to convolve the composite signal with the reference signal.

9. An apparatus according to any of claim 6 wherein the reference signal is a time reversed complex conjugate of at least a portion of the signal to be transmitted by the antenna and the comparator is adapted to convolve each extracted signal directly with the reference signal.

10. An apparatus according to any of claims 6 wherein the reference signal and the signal or signals to be compared with it are digital signals and the comparator comprises a digital matched filter.

11. An apparatus according to claim 10 included in a time distributed multiple access digital cellular radio communication system in which signals are in the form of signal busts separated by guard periods, each signal burst including a midamble reference signal and the matched digital filter acts as a finite impulse response filter having a number of taps equal to the number of complex correlation bits in each signal burst and the taps have weights derived from the time reversed complex conjugate of the midamble of the signal bursts.

* * * * *